US006599669B2

(12) United States Patent
Aylward et al.

(10) Patent No.: US 6,599,669 B2
(45) Date of Patent: Jul. 29, 2003

(54) IMAGING ELEMENT WITH NACREOUS PIGMENT

(75) Inventors: Peter T. Aylward, Hilton, NY (US); Robert P. Bourdelais, Pittsford, NY (US); Alphonse D. Camp, Rochester, NY (US); Pamela M. Ferguson, Farmington, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,335

(22) Filed: Aug. 16, 2001

(65) Prior Publication Data

US 2003/0044736 A1 Mar. 6, 2003

(51) Int. Cl.[7] ..... G03C 3/00; G03C 1/93; G03C 1/825; G03C 1/76

(52) U.S. Cl. ..... 430/11; 430/14; 430/220; 430/496; 430/510; 430/523; 430/533; 430/536; 430/539; 430/961

(58) Field of Search ..... 430/11, 14, 220, 430/446, 510, 523, 533, 536, 961, 539; 347/106

(56) References Cited

U.S. PATENT DOCUMENTS

| | | | | | |
|---|---|---|---|---|---|
| 3,923,513 | A | * | 12/1975 | Evans | 430/217 |
| 4,216,018 | A | | 8/1980 | Bilofsky et al. | 430/220 |
| 4,242,428 | A | * | 12/1980 | Davis | 430/9 |
| 4,269,916 | A | | 5/1981 | Bilofsky et al. | 430/220 |
| 4,288,524 | A | | 9/1981 | Bilofsky et al. | 430/220 |
| 4,579,810 | A | * | 4/1986 | Johnson et al. | 430/536 |
| 4,613,563 | A | * | 9/1986 | Murai | 430/523 |
| 4,910,235 | A | * | 3/1990 | Satake et al. | 523/171 |
| 5,126,237 | A | | 6/1992 | Okumura et al. | |
| 5,194,366 | A | * | 3/1993 | Grubb | 430/291 |
| 5,340,692 | A | | 8/1994 | Vermeulen et al. | 430/233 |
| 5,350,733 | A | | 9/1994 | Campbell et al. | |
| 5,466,519 | A | | 11/1995 | Shirakura et al. | 430/538 |
| 5,637,438 | A | * | 6/1997 | Maerz et al. | 430/253 |
| 5,733,658 | A | | 3/1998 | Schmid et al. | |
| 5,858,078 | A | | 1/1999 | Andes et al. | |
| 5,866,282 | A | | 2/1999 | Bourdelais et al. | 430/536 |
| 5,888,681 | A | | 3/1999 | Gula et al. | 430/536 |
| 6,030,759 | A | | 2/2000 | Gula et al. | 430/536 |
| 6,071,654 | A | | 6/2000 | Camp et al. | 430/536 |
| 6,071,680 | A | | 6/2000 | Bourdelais et al. | 430/536 |
| 6,274,284 | B1 | | 8/2001 | Aylward et al. | 430/536 |

FOREIGN PATENT DOCUMENTS

| | | |
|---|---|---|
| EP | 0 864 621 | 9/1998 |
| EP | 0 977 083 | 2/2000 |
| JP | 61/259246 | * 11/1986 |
| JP | 2001-201822 | 1/2001 |

OTHER PUBLICATIONS

Derwent Abst of JP 61/259,246, Nov. 1986.*
J PAB Abstr. of Jp 61/259,246, Nov. 1986.*

* cited by examiner

*Primary Examiner*—Richard L. Schilling
(74) *Attorney, Agent, or Firm*—Paul A. Leipold

(57) ABSTRACT

The invention relates to a photographic element comprising nacreous pigment.

24 Claims, No Drawings

IMAGING ELEMENT WITH NACREOUS PIGMENT

FIELD OF THE INVENTION

This invention relates to imaging materials. In a preferred form, it relates to nacreous photographic reflective paper.

BACKGROUND OF THE INVENTION

Prior art reflective imaging output materials such as silver halide reflective images or ink jet reflective images typically comprise imaging layers applied to a white reflective base material. The white reflective base reflects ambient light back to the observer's eye to form the image in the brain. Prior art base materials typically utilize white reflecting pigments such as $TiO_2$ or barium sulfate in a polymer matrix to form a white reflective base material. Prior art reflective photographic papers also contain white pigments in the support just below the silver halide imaging layers to obtain image whiteness and sharpness during image exposure, as the white pigment reduces the amount exposure light energy scattered by the cellulose paper core. Details on the use of white pigments in highly loaded coextruded layers to obtain silver halide image sharpness and whiteness are recorded in U.S. Pat. No. 5,466,519.

It has been proposed in U.S. Pat No. 5,866,282 (Bourdelais et al) to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. The composite imaging support structure described in U.S. Pat. No. 5,866,282 has been found to be more durable, sharper and brighter than prior art photographic paper imaging supports that use cast melt extruded polyethylene layers coated on cellulose paper.

It has been proposed in U.S. Pat. No. 6,071,680 (Bourdelais et al) to utilize a voided polyester sheet coated with light sensitive silver halide imaging layers for use as photographic output material. The voided layer in U.S. Pat. No. 6,071,680 improves opacity, image lightness, and image brightness compared to prior art polyethylene melt extrusion coated cellulose paper base materials. The image base proposed in U.S. Pat. No. 6,071,680 also contains an integral polyolefin skin layer to facilitate imaging layer adhesion at the time of manufacture and during the processing of silver halide imaging layers.

There, however, remains a continuing need for improvements to the appearance of imaging output materials. It has been shown that consumers, in addition to reflective output material, also prefer nacreous images. Nacreous images exhibit a pearly or nacreous luster, an iridescent play of colors, and a brilliant luster that appears in three dimensions. Nacreous appearance can be found in nature if one examines a pearl or the polished shell of *Turbo marmoratus*.

A nacreous photographic element with a microvoided sheet of opalescence is described in U.S. Pat. No. 5,888,681 (Gula et al). In U.S. Pat. No. 5,888,681 microvoided polymer sheets with microvoided polymer layer located between a cellulose paper base and developed silver halide imaging provide an image with an opalescence appearance. The nacreous appearance is created in U.S. Pat. No. 5,888,681 by providing multiple internal reflections in the voided layer of the polymer sheet. While the opalescence appearance is present in the image, the image suffers from a loss of image sharpness or acutance, a higher density minimum position, and a decrease in printing speed compared to a typical photographic image formed on a white, reflecting base. It would be desirable if the opalescent look of the image could be maintained while improving printing speed, increasing sharpness, and decreasing density minimum. Also, while the voided polymer does provide an excellent nacreous image, the voided layer, because it is pre-fractured, is subjected to permanent deformation, thus reducing the quality of the image.

In addition to the use of white pigments in reflective consumer photographs, white pigments are also utilized in photographic display materials for diffusion of illumination light source. While the use of white pigments in display materials does provide the desired diffusion and reflection properties, the white pigments tend to change the hue angle of the color dyes in a developed photographic display image. Dye hue angle is a measure in CIElab color space of that aspect of color vision that can be related to regions of the color spectrum. For color photographic systems there is a perceptual preferred dye hue angle for the yellow, magenta, and cyan dyes. It has been found that when photographic dyes are coated on support containing white pigments, the hue angle of the developed image changes compared to the hue angle of the dyes coated onto a transparent support. The hue angle change of photographic dyes caused by the presence of white pigments often reduces the perceived quality of the dyes compared to the dye set coated on a transparent base that is substantially free of white pigments. It would be desirable if a developed photographic dye set coated on a reflective support material had a dye hue angle that was not significantly different than the same dye set coated on a transparent support.

Nacreous pigments added to a matrix, such as paint or plastic, have been known to exhibit a nacreous appearance. The prior art use of the nacreous pigments have been for pigmenting paints, printing inks, plastics, cosmetics, and glazes for ceramics and glass. Nacreous pigments are dispersed in a matrix and then painted or printed onto a substrate. Pearl luster pigments containing titanium dioxide have been successfully employed for many years. They are constructed in accordance with the layer substrate principle, with mica being employed virtually without exception as substrate.

Mica pigments are used widely in the printing and coating industries, in cosmetology, and in polymer processing. They are distinguished by interference colors and a high luster. For the formation of extremely thin layers, however, mica pigments are not suitable, since the mica itself, as a substrate for the metal-oxide layers of the pigment, has a thickness of from 200 to 1200 nm. A further disadvantage is that the thickness of the mica platelets within a certain fraction defined by the platelet size in some cases varies markedly about a mean value. Moreover, mica is a naturally occurring mineral which is contaminated by foreign ions. Furthermore, technically highly complex and time-consuming processing steps are required including, in particular, grinding and classifying.

Pearl luster pigments based on thick mica platelets and coated with metal oxides have, owing to the thickness of the edge, a marked scatter fraction, especially in the case of relatively fine particle-size distributions below 20 micrometers. As a substitute for mica, it has been proposed to use thin glass flakes which are obtained by rolling a glass melt with subsequent grinding. Indeed, interference pigments based on such materials exhibit color effects superior to those of conventional, mica-based pigments. Disadvantages, however, are that the glass flakes have a very large mean thickness of about 10–15 micrometers and a very broad thickness distribution (typically between 4 and 20 micrometers), whereas the thickness of interference pigments is typically not more than 3 micrometers.

In U.S. Pat. No. 5,340,692 (Vermeulen et al) an imaging receiving material with nacreous pigment for producing contone images according to the silver salt diffusion process is disclosed. According to the process disclosed in U.S. Pat. No. 5,340,692, contone images with an antique look can be obtained utilizing the silver salt diffusion transfer process without the need of special processing liquids using a nacreous pigment in the imaging receiving layer or located between the support and the image receiving layer. The silver halide imaging layers used are created with retained silver and, therefore, are not semitransparent. Because the nacreous pigments used are contained in the imaging receiving layer and not silver halide imaging layer, the image form will not have a uniform nacreous appearance, as the density of the transferred silver halide image block the multiple reflections from the nacreous pigments. Further, the nacreous pigments utilized are too large and in too great a concentration to be included in the silver halide imaging layer as a rough surface would result, reducing the desired nacreous appearance of the image. The gold flakes used in the example in U.S. Pat. No. 5,340,692 are an attempt to simulate prior art black-and-white photographic "Sepatone" appearance produced during a post process treatment of the imaging layers. While the image in the example does have an antique appearance, the image does not have a nacreous appearance.

In U.S. Pat. No. 4,269,916 (Bilofsky et al) and related patents U.S. Pat. No. 4,288,524 and U.S. Pat. No. 4,216,018, instant photographic products having reflective layers which comprise lemellar interference pigments are disclosed. The intended use of the lemellar pigments is to create a pleasing white reflective appearance for the base material without the need for blue tints. It has been proposed that flat particles of metal oxides created by coating salts with metal oxides and later dissolving the salts leaving a thin flake of metal oxide as a substitute for spherical $TiO_2$ particles. Titanium dioxide particles typically are utilized in photographic art to create a white reflective surface for the viewing of print materials. The intent of U.S. Pat. No. 4,269,916 is to provide a white reflecting surface that does not have an angular viewing appearance and a consistent L*, thus the invention materials do not exhibit a nacreous appearance. Examples in U.S. Pat. No. 4,269,916 show high reflectivity at a variety of collection angles which is opposite of a nacreous appearance where reflectivity changes as a function of collection angle. Further, the lemellar pigments are not present in the silver halide imaging layers or in the base materials used in the invention.

In U.S. Pat. No. 5,858,078 (Andes et al), a process for the production platelet like, substrate free $TiO_2$ pigment is disclosed for use in printing inks, plastics, cosmetics and foodstuffs is.

In U.S. Pat. No. 5,733,658 (Schmid et al) luster pigments obtainable by treating titania coated silicate based platelets from 400° C. to 900° C. with a gas mixture comprising a vaporized organic compound and ammonia are described as useful for coloring paints, inks, plastics, glasses, ceramic products, and decorative cosmetic preparations.

When imaging supports are subject to variations in ambient conditions over long periods of time, the image-containing layers and resin layers tend to deteriorate into a mass of cracks which are aesthetically undesirable and which, in extreme cases, extend over the entire print completely destroying the image. All polymers are inherently prone to chemical degradation that leads to loss of mechanical properties. They undergo thermal degradation during processing such as extrusion of thin films, and photooxidative degradation with long-term exposure to light. The $TiO_2$ utilized in U.S. Pat. No. 5,858,078 and U.S. Pat. No. 5,733,658 catalyzes and accelerates both thermal and photooxidative degradation. In the art of resin coating imaging papers, the melt polymers are extruded at high temperatures and are also subjected to high shear forces. These conditions may degrade the polymer, resulting in discoloration and charring, formation of polymer slugs or "gels", and formation of lines and streaks in the extruded film from degraded material deposits on die surfaces. Also, thermally degraded polymer is less robust than non-degraded polymer for long-term stability, and may thereby shorten the life of the print.

It has been shown that when imaging layers (silver halide, ink jet, flexography, laser toner, and the like) are applied to nacreous base materials, the nacreous appearance of the image is optimized when the image forming layers contain semitransparent dyes. The use of pigmented inks and dyes in the imaging layers tend to reduce the nacreous appearance of the image. In U.S. Pat. No. 6,071,654 (Camp et al) silver halide imaging layers that are semitransparent are coated on a nacreous support containing a voided polymer layer. The voided polymer layers create flat platelets oriented parallel to each other. The reflection which reaches the eye is primarily specular. It arises in depth, since each transparent polymer platelet reflects some of the incident light and reflects the remainder. The images in U.S. Pat. No. 6,071,654 exhibit a nacreous appearance.

PROBLEM TO BE SOLVED BY THE INVENTION

There is a need for a reflective imaging material that provides a nacreous or pearlescent appearance without having to have a special base while, at the same time, maintains photographic sharpness or printing.

SUMMARY OF THE INVENTION

It is an object of the invention to provide improved photographic materials.

It is another object to improved image appearance compared to prior art voided base photographic materials.

It is a further object to provide photographic materials that have a nacreous appearance independent of the base material.

These and other objects of the invention are accomplished by a photographic element comprising nacreous pigment.

ADVANTAGEOUS EFFECT OF THE INVENTION

The invention provides brighter, snappy images that sparkle while having exceptional photographic sharpness and exposure speed. Further the images have a desirable nacreous appearance that does not require a special base.

DETAILED DESCRIPTION OF THE INVENTION

The invention has numerous advantages over prior art photographic reflective materials. The reflective materials of the invention provide an image with a nacreous appearance while maintaining efficient reflection of light, sharpness, and photographic speed. Maintaining image sharpness and whiteness is important, as consumers expect silver halide images to be high in quality. Further, maintaining printing speed is critical for efficient photographic processing, as a significant loss in printer speed could increase the cost of consumer silver halide images.

The nacreous imaging materials of the invention provide an eye-catching appearance that make them particularly desirable in imaging applications that require obtaining the attention of the consumer. One example includes display materials that are intended to communicate an advertising message to people in a public setting such as a bus stop, train station, or airport. The nacreous images are differentiated in look from prior art materials and, thus, provide the pop and sizzle that can catch the consumer's attention. By providing the nacreous image with a pressure sensitive adhesive, the tough, durable nacreous image can be applied to various surfaces, which is particularly desirable for the youth market.

Photographic nacreous labels of the invention utilized in packaging markets enable a differentiated look and consumer appeal on store shelf. The utilization of the thin, flexible, and tough silver halide materials results in a packaging material having many superior properties. The packaging materials of the invention have a depth of image unsurpassed by existing packaging materials. The packaging materials of the invention may be utilized with a variety of packaging materials that are suitable pressure sensitive labeling, such as shampoo bottles, perfume bottles, and film boxes. The packaging materials of the invention, while having the advantage of superior image, are available on thin base materials which are low in cost while providing superior opacity and strength. The packaging materials of the invention, as they may be imaged by flash optical exposure or digital printing, have the ability to be formed in short runs and to be rapidly switched from one image to the next without delay.

The term "nacreous" refers to a pearly, luster, and nacreous appearance. This may include a metallic, lustrous, and somewhat iridescent effect. The nacreous effect is the result of interference pigments that are platelet-like in their structure. Typically these are elongated platelet-like structures of silicate-based materials such as mica, feldspar, and quartz. These pigments tend to cause specular and diffuse reflection, and they also transmit some light. The use of nacreous pigments in the paint and printing industry are typically designed to create a variety of eye-popping colors. These materials are typically coated over dark black backgrounds to help accentuate the eye-popping optical effects. Special metal oxide coatings are applied to mica particles in very thin layers. This allows for some light to be refracted, while other light will transmit through to the near transparent layers of the mica particle to be refracted at a slightly different angle. Since these pigments are suspended in a binder polymer of yet another refractive index, there are multiple light refractions that create a lustrous appearance. In addition, the chemistry of the coating that is applied to the mica particles may be varied to create various colors. Metal oxide coatings that may be used in an embodiment of this invention include titanium, iron, chromium, barium, aluminum, zinc, zirconium, bismuth vanadate, nickel titanate, chromium titanate, lead, and others. While these produce some exciting colors in the field of photography and imaging, traditional print materials have a white background. Additionally, it should be noted that the thickness of the metal oxide coating on the mica may also impact the color. In a preferred embodiment of this invention the metal oxide coating on the mica particles may comprise titanium, aluminum, and/or barium. These materials are preferred because it is desirable to have a more traditional white background that can be achieved with these materials. The most preferred metal oxide is titanium because of its superior whiteness. Typically it is important to control the thickness of the metal oxide coating to less than 120 nanometers to achieve a blue white appearance.

With nacreous pigments used in imaging application, it may be desirable to have non-uniform platelet thickness and small particles to create a white nacreous appearance. In imaging application where a different look is desirable, the use of thicker particles and more uniform spacing of platelets to each other creates a color interference that is more characteristic of mother-of-pearl. In general, the lustrous pigments referred to in this invention are pigments that consist of flat mica platelets coated with titanium dioxide or other metal oxides. They are irregular in shape and may vary in thickness from 0.1 to 0.5 micrometers, although some individual particles may be thicker. The particles may have a length of up to 500 micrometers. The coating applied to the mica particles should be controlled in thickness, but the overall thickness is one parameter that controls the overall color appearance. Each transparent coating helps to create the lustrous or pearlescent effect. The particle of these pigments influences the perceived texture of the pearl luster effect and adds a new dimension of beauty and quality to the image. The coating may be colored with other compatible transparent pigments and dyestuffs. Metallic effects can be simulated by adding small amounts of carbon black with some silvery white pigments. The color seen is different than color pigments and dyes in that the color and lustrous iridescence is produced by light interference and not absorption or reflection of light. This is a surprisingly unique attribute to the field of silver halide photography and imaging. With the use of nacreous pigments there are many refractive interface that can produce a unique appearance to an imaging element. A light ray striking a layer containing nacreous platelets must pass through a substantially transparent layer of relatively lower refractive index binder polymer surrounding the platelet, and then the ray is then partially reflected by the metal oxide coating on the surface. The remaining part passes into the metal oxide coating layer and is again reflected as it exits the layer at the interface with the mica particle. Since the coating is very thin and the mica platelets are substantially transparent, the remaining light has many opportunities to be reflected at different angles. This helps to provide the luster nacreous appearance, as well as to add a three-dimensional quality to the image. The resulting color effect that is produced depends on the light reflection from the interfaces, as well as the type of coating on the mica particles. The multiple interfaces cause the reflected light to be slightly out of phase. It should also be noted that the color varies based on the angle of illumination and that an iridescence effect can be seen. Control of this effect is desirable depending on the effect that needs to be conveyed by the image. As noted above the thickness and type of the coating on the mica particles are factors that need to be considered. In addition the particle size can also be used to control the effect. For use in a photographic element it is desirable to have a smooth surface. To achieve this, a small particle is best but the layer thickness of the binder polymer in which the pigments are suspended may also be increased as well as applying clear overcoats. Larger particles are desirable when a bold effect with visual impact is desired. The nacreous effect can be changed by adjusting the particle size, metal oxide coating thickness and type, as well as the concentration of the pigment. In general, low pigmentation levels are better at producing a three-dimensional effect. This effect may be enhanced by applying a thick clear layer over the top of the nacreous pigments. When a more metallic sheen is desired, higher pigmentation levels are best. It should also be noted that different effects may be achieved by adding other transparent pigments and dyes in the layers. Since light sensitive photographic layers produce dye couplers that are semitransparent and typically do not contain pigment particles; they are uniquely positioned to be able to create synergistic effects with the nacreous pigments.

The nacreous pigments are relatively stable and generally resistant to alkali and acids, as well as high temperature. They can be dispersed in most carrying (binder polymer) media. Since the particles are substantially transparent, the use of a carrying media that is also transparent provides the maximum effect. If a more translucent carrying media is used, more nacreous pigment may be needed to achieve the same level of nacreous appearance.

In some applications it may be desirable to also have a nacreous pigment that is also conductive. This has some unique advantages in the area of photography that uses light sensitive layers. Static accumulation and discharge can result in a fogged layer. Being able to provide a conductive path that helps to prevent the charge from building up is an important element for imaging media. This not only helps prevent light fogging of light sensitive layer, but also allows sheets to slide over each other and various equipment parts without static buildup or cling of one sheet to another. This type of pigment is also a means of adding conductivity to the emulsion side of a photographic element. Conductive nacreous pigments consist of an inter core of platelet mica that is coated with materials such as $TiO_2$, $SiO_2$ and further coated with an outer layer of dense layer of conductive, inorganic mixed metal oxide. A typical material is antimony-doped tin dioxide. The elongated particles of mica are useful in providing a conductive pathway when particles are touching.

The origin of the beauty of a genuine pearl has been well documented. It is known that its luster and color come from the multiple smooth concentric layers of nacre, i.e., calcium carbonate layer, organic constituent (conchiolin) layer. Each of these layers partially reflects and transmits light. Hence, a sense of depth and luster is observed in the reflection. Pigments that try to simulate the visual effect of a pearl are called as pearlescent or nacreous pigments. The first nacreous pigment was the natural pearl. The commercial grades of nacreous pigments are made of thin transparent platelets of high refractive index. These pigments are so designed that multiple reflections and transmissions occur and, as a result, a sense of depth is obtained in the overall reflected image. The characteristics of the pigment determine whether color is produced by light interference (specifically called as interference pigments) or no color is produced (called as white nacreous pigments).

Some of the earliest pearlescent pigments were the platelike bismuth oxychloride crystals, and basic lead carbonate. These pigments reflect light similar to a pearl essence crystal. Due to toxicity of lead, bismuth oxychloride (BiOCl) crystals have seen an increased use in the marketplace. BiOCl is generally crystallized from solution into smooth, thin platelets which has a particle size ranging from 5 $\mu$m and 15 $\mu$m.

The other commonly used pearlescent pigments are those made from mica coated with either titanium dioxide (U.S. Pat. No. 4,040,859), iron oxide (U.S. Pat. No. 3,087,829), zirconium dioxide (U.S. Pat. No. 3,087,828), or other high refractive index materials. Mica is used because it is transparent to light and can be cleaved into extremely thin flakes. Examples of mica suitable for pearlescent pigments are muscovite, paragonite, phlogopite, biotite, and lepidolite. The mica platelets are then coated with a thin single layer or multiple layers of high refractive index inorganic oxide. The reflection efficiency depends to a large extent on the refractive index difference between the mica platelet and the inorganic oxide coating. This layered structure enables it to function like a pearlescent pigment. The oxide coating provides the optical effects like luster, interference reflection color (if oxide coating is sufficiently thick) and absorption color (if the oxide contains color material). The size of the mica particle also plays an important role in determining the final reflected image. The weight of the mica in the pigment usually lies between 40% and 90% and most usually in the range of 60% and 80%. If titanium dioxide is used as the coating and its coating thickness is increased, then an iridescence effect (color) is observed. The dimensions of pearlescent pigments used in this invention may be between 5 $\mu$m and 400 $\mu$m and preferably between 5 $\mu$m and 100 $\mu$m because particles less than 5 $\mu$m are not very efficient in creating the nacreous appearance, while particles greater than 100 $\mu$m progressively get rougher. Excessive roughness on the surface tends to shut down the nacreous appearance. The thickness of the pigment is preferably between 0.1 $\mu$m and 0.6 $\mu$m and more preferably between 0.2 $\mu$m and 0.4 $\mu$m. Particles less than 5 $\mu$m or less than 0.2 $\mu$m typically do not have sufficiently higher nacreous appearance, while particles greater than 400 $\mu$m in length or 0.6 $\mu$m in width typically are very large and tend to create roughness which starts to shut down the nacreous effect.

Other optically variable pigments that are suitably used are silicon oxide coated with thin layers of aluminum (5 nm and 10 nm) or titanium dioxide, and magnesium fluoride crystals coated with chromium have also been used. These pigment structures have been highlighted in U.S. Pat. No. 3,438,796. New optically variable pigment structures based on coated platelet like metallic substrates have been disclosed in U.S. Pat. No. 5,364,467 and U.S. Pat. No. 5,662,738. U.S. Pat. No. 5,976,511 discloses pigments composed of barium sulfate particles and coated with zinc oxide, cerium oxide, or titanium dioxide which have a pearly luster.

The photographic elements of this invention may utilize an integral emulsion bonding layer that allows the emulsion to adhere to the support materials during manufacturing and wet processing of images without the need for expensive subbing coatings.

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image. Nacreous appearance is a pearly, luster, iridescent, metallic sheen. A characteristic property of a nacreous appearance is an angular dependence of viewing angle.

For the imaging element of this invention, imaging layers are generally applied to a white reflective base, and the image layers comprise nacreous materials. In the invention a photographic element comprises nacreous pigments. This embodiment is preferred because said photographic element that comprises nacreous pigment has a unique pearly luster appearance. Such a photographic element has a unique capability to preserve images with special luster sheen that is not available in traditional photographs or commercial displays. A preferred embodiment of this invention comprises nacreous material in a photographic layer which is on a white reflective base. The white reflective base provides an excellent surface and background while viewing prints. In particular, it is desirable to have a white reflective base that has an L* of greater than 92. L* greater than 92 are desirable because they provide good contrast to the image and are pleasing to the viewer. Highly reflective whites are highly desirable from a final consumer standpoint. L* or lightness and opacity were measured for using a Spectrogard spectrophotometer, CIE system, using illuminant D6500.

In a further embodiment of this invention it is desirable to have a base with a surface smoothness of less than 0.8 micrometers. Having a base that is smooth is desirable in providing an image surface that is relatively free of orange peel and has a high level of gloss. Most consumers desire a smooth base because the high level of gloss helps to accent the nacreous appearance.

For the purpose of this invention the photographic element comprises silver halide emulsion. Said silver halide emulsion may comprise more than one layer. It should also be noted that some layers may comprise light sensitive silver halide materials, and other layers may not contain light sensitive materials.

In this invention the photographic element comprises nacreous pigments. The element may have nacreous pigment in a layer that comprises silver halide emulsion; that is, the nacreous pigment is in the same layer or layers that have the light sensitive silver halide emulsion. After the silver halide is exposed and processed, the nacreous pigment provides a source of additional spectral reflection that provides a unique appearance to the image. Since the silver halide emulsion has more than one layer, and in the case of color emulsions there may be at least three or more layers each capable of capturing light of a different wavelength, said nacreous pigment may be in one or more layers. This will allow only certain colors or all colors to demonstrate the nacreous appearance.

In a preferred additional embodiment the nacreous pigment may be in a layer of the photographic element that is free of silver halide emulsion. It is common knowledge that photographic emulsions have multiple layers in which the light sensitive layers are separated by an interlayer and furthermore have a size overcoat in the topmost position that are not light sensitive. In this embodiment the nacreous material is located above or below a layer or layers that further comprise silver halide. This embodiment is preferred because the nacreous pigments do not have to be fully compatible with the silver halide emulsion and are, therefore, less likely to interfere with image development or keeping. The nacreous appearance is still present after the image is formed and developed. In an additional embodiment the nacreous pigment is in a layer on the surface or adjacent to the surface of said photographic element. In this embodiment the reflected light of the exposed and developed image creates a nacreous appearance to the image. In yet another preferred embodiment of said photographic element, said nacreous pigment is in a layer below said bottommost layer comprising silver halide. This embodiment is preferred because light is allowed to expose the silver halide as it passes through the layers, but the secondary light that bounces back from the base is impacted by the nacreous pigments. This provides a very soft nacreous appearance to the image.

In a preferred embodiment of this invention the nacreous pigments comprises mica. Coated mica is preferred because it has a platelet structure that, when coated with metal oxides, has a nacreous appearance that provides a very unique look to an image which is appealing. Furthermore, said mica may be easily dispersed and coated in a layer or layers that comprise silver halide emulsion, as well as layers that are free of or at least substantially free of silver halide emulsion. For the purpose of this invention the term "mica" refers to nacreous materials and includes mica, feldspar, quartz, silicates, modified mica, and mica that has been coated with a metal oxide, mica coated with materials that have a difference in refractive index greater than 0.2. The mica material may be a translucent organic and/or inorganic materials and may have a nacreous effect when viewed from different angles.

In other suitable embodiments of this invention, nacreous pigments may be incorporated in either or both the light sensitive emulsion layers and the size overcoat. Nacreous pigments have been shown to be an effective means to filter UV radiation. This has significant advantage to minimize photographic dye fade.

In an additional embodiment of this invention, said photographic element comprising a nacreous pigment further comprises electrical resistant of less than $10^{13}$ log ohms per square. Electrical resistance less than $10^{13}$ is desirable to prevent static buildup and discharge that can cause the light sensitive layer to fog.

In yet an additional embodiment of this invention, said photographic element that comprises said nacreous pigment has a mean particle size between 0.5 and 50 micrometers. Particles less than 0.5 micrometer in size tend not to have a sufficient platelet structure to create a strong nacreous appearance. It should be noted that small particle sizes in the preferred range have less of a scattering impact on the light sensitive layers and, therefore, have minimal interference with the exposure of the silver halide and sharpness. The smaller particle sizes are further desirable with the relatively thin layer of a photographic emulsion to minimize roughness that can cause excessive light scattering. Larger particles are desirable to get more efficient nacreous appearance, but particles greater than 50 micrometers are very rough and difficult to incorporate in or around light sensitive layers. Typically the large particles should be coated in layers several times thicker than the particle.

In a preferred embodiment of this invention said photographic element has a b* less than 10. A b* less than 10 is desirable for photographic print material because of the customer traditional expectation of a white appearing print. Furthermore, b* less than 10 provides excellent contrast to other colors. There are many color shades of white. Blue whites are desirable to make the whites look whiter, while less blue or more yellow whites are desirable for warmer tones images. Other color tints may be used for other shades of white, while optical brighteners may be used in conjunction with the nacreous pigments to make the whites more blue appearing. Nacreous pigments with colors other than white may be used to create special effects or color schemes.

In this invention the nacreous pigments may comprises between 0.5 and 1000 mg/m$^2$ of the photographic element. Nacreous pigment levels below 0.5 mg/m$^2$ are difficult to detect and generally do not have a nacreous impact. Nacreous pigment levels above 1000 mg/m$^2$ do not have a proportional improved nacreous appearance for the additional expense. Furthermore, if the level is above 1000 mg/m$^2$, the nacreous pigments tend to stack more vertically and their impact is decreased. In a preferred embodiment of this invention, said nacreous pigments are present in the amount between 7 and 250 mg/m$^2$. Below 7 mg/m$^2$ the nacreous appearance is more difficult to see, while levels above 250 mg/m$^2$ do not have a significantly improved nacreous appearance for the additional expense. When nacreous pigments are incorporated in and/or above silver halide layers, the amount of the nacreous pigment should be kept low to minimize interference with the image exposure. Higher level in the preferred range tend to have a stronger nacreous appearance which is desirable in certain applications for display or youth markets where a different look is valued. In the preferred embodiment of this invention, the nacreous pigment should comprise between 0.1 to 9% by volume of the photographic emulsion. Levels below 0.1% have minimal nacreous appearance, while levels above 9% cause excessive stacking of the platelets which tends to interfere with the nacreous appearance. Additionally it is desirable to have the nacreous pigments as the only pigment in a substantial clear polymer. The inclusion of other solid particles tends to cause more light scattering and, therefore, reduces the nacreous effect.

Nacreous or pearlescence appearing media has shown to be highly desirous from a commercial standpoint. Incorporation of nacreous pigments in a substantially transparent substrate or construction of composite materials containing localized voiding of a specific geometry, orientation, and formulation can produce both "colored" nacreous and "white" nacreous media. For both types, this nacrescence results in perceived depth, luster, and a metallic appearance. Correct measurement of these materials is required for robust design.

For both pigment and voiding methods, "white" nacreous luster is a function of the orientation, as well as the spacing and composition of the materials. The luster and depth appearance of the media are mainly due to the reflected light that reaches the eye. Both pigments and voids that provide a nacreous appearance function as substantially transparent platelets oriented parallel to each other. This results in depth as each platelet reflects some of the incident light while transmitting the rest. Any imperfections due to surface defects or platelet or void orientation misalignments will cause the light to be scattered in a non-specular direction, and will degrade the nacreous appearance of the material.

In addition, the natural tendency for randomness in regards to platelet or void alignment and spacing will render the media incapable of producing color by light interference. Any color produced by one alignment and spacing will have a tendency to be counteracted by other encountered alignments and spacing. However, gross geometric misalignments of the platelets or voids will also result in less than desirable functionality, and a method of measuring this defect is required as well.

FLOP is a test method used to measure the nacreous quality of materials of interest. 45-degree incident light is collected at 10, 45, and 110 degrees from the specular reflection angle. The spectrophotometric output, e.g., CIE L* (L1*, L2*, L3* respectively) is used as follows:

$$FLOP=15(L1^*-L3^*)^{1.11}/L2^{*0.86}$$

whereby FLOP values between less than 10 have no nacreous appearance and FLOP values greater than 10 are indicative of a nacrescent appearance.

Furthermore, quality monitoring of these nacreous materials, when combined with one or more semitransparent color forming dyes layers, places limitations on the usefulness of measurements taken with typically found reflection densitometers having 0/45 geometry. This is due to the angular dependency of these media. This angular viewing dependency of the media and the inherent randomness of the structure will result in errors "reading out" the dye formed due to the variability of the media at any one collection angle. These highly specular and translucent materials will reflect some light in angular dependent non-specular directions as well. It has been found that although incident light and collection at 0/45 will allow for a prediction of density minimum versus FLOP, these values are no longer predictive, as density increases from density minimum to density maximum as color dye forming layers are added to the media.

This can be explained as a function of the dye density. As density increases, the ability for multiple reflections through the media decreases. As the reflection passes approach one, the nacreous look will no longer be apparent.

Spectrogoniometric measurements can be employed to measure the media at various angles, but spectrogoniometric readings are tedious and the apparatus is expensive. An alternative for quality monitoring purposes to assess the amount of color forming layers coated and subsequently processed would be useful. During a color photographic coating operation, the need to reduce inherent manufacturing variability of color forming coupler levels is required and this data collection by conventional reflection 0/45 densitometry is impeded by the natural variability found in the nacreous media. Slight changes in the reflective properties of the base media will result in more or less light reaching the densitometer which, in turn, can result in an erroneous readout of the formed dye.

One such method to provide correct assessment during a coating operation would be to remove the nacreous properties of the media. This can be accomplished by collecting light from the prepared sample at a grazing angle that would minimize the nacreous layer contributions. Diffuse 8 degree sphere optical geometry handheld spectrophotometers have been shown to meet this need.

In a preferred embodiment of this invention, said photographic element comprising nacreous pigments wherein said element has a flop measurement of between 2 and 65. Flop measurements below 2 have little or no nacreous appearance, while flop measurements above 65 are difficult to achieve with nacreous pigments.

In a further embodiment of this invention, the photographic element further comprises a white reflective base that further comprises a surface roughness of less than 0.8 micrometer. Reflective bases greater than 0.8 micrometers tend to exhibit a roughness frequency that greatly reduces the nacreous appearance. Bases with a roughness of less than 0.8 micrometers are generally glossy in overall appearance which tends to maximize the nacreous appearance in an imaging print.

In a preferred embodiment of this invention, the photographic element comprising a nacreous pigment further comprises at least two exposed and developed images that are folded with the image sides out, and the non-image bearing sides are adhesively joined to form an album page. This embodiment is preferred because it allows the nacreous appearance to be utilized with album pages. Multiple images may be exposed and developed on one sheet of photographic element that contains nacreous pigment and then folded and joined to form a convenient display. The page can then be punched and used as part of an album page. In an additional embodiment, the exposed and developed photographic element may be folded using an apparatus for making an album leaf from an image-bearing sheet. The sheet has an image bearing side and a non-image bearing side, comprising:

a first roller about which said image bearing sheet is driven;

a second roller positioned adjacent said first roller so as to form a first nip there between, said second roller is used for driving an adhesive sheet into said first nip against said image bearing sheet that is driven by said first roller; and a third roller positioned adjacent said first roller so as to form a second nip there between, said third and said first roller moving in a direction which caused said image bearing sheet to be folded firmly about said adhesive sheet and move through said second nip so as to form an album leaf.

The imaging elements of this invention are photographic elements, such as photographic display films, photographic paper, or photographic glass plates, in which the image-forming layer is a radiation-sensitive silver halide emulsion layer. Such emulsion layers typically comprise a film-forming hydrophilic colloid. The most commonly used of these is gelatin, and gelatin is a particularly preferred material for use in this invention. Most of the nacreous pigments useful in this invention are easily dispersed in gelatin. Additional dispersing aids may be used with gelatin or other hydrophilic colloids. Most any aqueous dispersing aid known in the art of pigments and paints may be useful. Useful gelatins include alkali-treated gelatin (cattle bone or hide gelatin), acid-treated gelatin (pigskin gelatin), and gelatin derivatives such as acetylated gelatin, phthalated gelatin, and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion, or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

In addition to emulsion layers, the photographic layer can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers, and the like. The support can be any suitable support as described in this invention. Typical supports include polymeric films, polymeric film laminated to other polymeric, glass, and the like. The important thing is to have translucent support that is both reflective and diffusive. The light-sensitive silver halide emulsions employed in the photographic elements of this invention can include coarse, regular, or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions, although other hydrophilic colloids can be used in accordance with usual practice. Details regarding the silver halide emulsions are contained in and described in *Research Disclosure*, September 1994, Item 36544, Section I, published by Kenneth Mason Publications, Ltd., Dudley Annex, 12a North Street, Emsworth, Hampshire PO10 7DQ, ENGLAND as well as *Research Disclosure*, Item 36544, September 1994, and the references listed therein, as well as *Research Disclosure*, September 2000, Item 437013, published by Kenneth Mason Publications, Ltd., Dudley Annex, 12a North Street, Emsworth, Hampshire PO10 7DQ, ENGLAND.

The photographic silver halide emulsions utilized in this invention can contain other addenda conventional in the photographic art. Useful addenda are described, for example, in *Research Disclosure*, Item 36544, September 1994, and *Research Disclosure*, September 2000, Item 437013, published by Kenneth Mason Publications, Ltd., Dudley Annex, 12a North Street, Emsworth, Hampshire PO10 7DQ, ENGLAND. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Below in Table 1 is a typical photographic element which includes a size overcoat, three light sensitive silver halide emulsion units with a color dye forming, and interlayers to separate the various light sensitive layers. For the purpose of this invention, the nacreous comprising materials may be added individually to each light sensitive emulsion and interlayer of Table 1 or in more than one layer in any combination. Additionally the nacreous materials may be added to a layer under the emulsion such as in the gel sub or primer layer or as a separate additional layer.

TABLE 1

| |
|---|
| Size Overcoat |
| Red-sensitized |
| cyan dye image-forming silver halide emulsion unit |
| Interlayer |
| Green-sensitized |

TABLE 1-continued

| |
|---|
| magenta dye image-forming silver halide emulsion unit |
| Interlayer |
| Blue-sensitized |
| yellow dye image-forming silver halide emulsion unit |
| Gel Sub |
| Primer |
| Clear Polyester |
| $TiO_2$ in Polyester |
| Voided Polyester |
| $TiO_2$ in Polyester |
| Primer |
| Antistat |

These and other advantages will be apparent from the detailed description below.

The following examples illustrate the practice of this invention. They are not intended to be exhaustive of all possible variations of the invention. Parts and percentages are by weight unless otherwise indicated.

EXAMPLES

Examples 1 to 10

Examples 1 to 10 include a three-color emulsion prepared as described above. The light sensitive emulsion is coated on any standard photographic white reflecting base as in Table 2. Some bases that may be used are white pigmented polyethylene resin coating on paper or polyester base, white pigment incorporated in polyester, white pigmented and/or voided biaxially oriented polymer base laminated to a base substrate. The base used in these examples as well as the control was the same. It represents a typical photographic paper base of approximately 160 g/m$^2$ of photo quality paper with 26 g/m$^2$ pigmented of polyethylene. This layer contains approximately 12% by weight of anatase $TiO_2$, an optical brightener and blue tints. On the backside was a layer of 28 g/m$^2$ of clear polyethylene. In the control and sample 7 there are no nacreous pigments in any layer, while in Examples 1 to 6 and 8 to 10, a nacreous pigment was placed in at least one layer. Table 4 below indicates the layer or layers that contained the nacreous pigment. The nacreous pigment used was Afflair 110, a fine particle blue white pigment supplied by EM Industries, Inc. The pigment was dispersed in gelatin using typical mixing. The gel lay down was approximately 39 g/m$^2$, and the pigment weight was coated at 19.4 g/m$^2$ in each layer, and a second series was coated at 190 g/m$^2$. The coating layer was dried and then an image was exposed and developed using RA-4 chemistry.

TABLE 2

| |
|---|
| Size Overcoat |
| Red-sensitized |
| cyan dye image-forming silver halide emulsion unit |
| Interlayer |
| Green-sensitized |
| magenta dye image-forming silver halide emulsion unit |
| Interlayer |
| Blue-sensitized |
| yellow dye image-forming silver halide emulsion unit |
| $TiO_2$ Polyethylene |
| Paper |
| Clear Polyethylene |
| Antistat |

Example 11 was the same as the other examples except that it contains one extra layer in the emulsion coating in the bottommost position. This layer contained approximately 45 g/m$^2$ of photo grade gelatin and 0.5% by volume of the same nacreous pigment described above.

TABLE 4

| Example | 1 | 2 | 3 | 4 | 5 | 6 | 7 | 8 | 9 | 10 | 11 | Control |
|---|---|---|---|---|---|---|---|---|---|---|---|---|
| SOC | Y | N | N | N | N | N | N | Y | Y | N | N | N |
| Red Sensitive Layer | N | Y | N | N | N | N | N | Y | N | Y | N | N |
| Interlayer | N | N | Y | N | N | N | N | Y | Y | N | N | N |
| Green Sensitive layer | N | N | N | Y | N | N | N | Y | N | Y | N | N |
| Interlayer | N | N | N | N | Y | N | N | Y | Y | N | N | N |
| Blue sensitive Layer | N | N | N | N | N | Y | N | Y | N | Y | N | N |
| Sub Coating Base | N | N | N | N | N | N | N | N | N | N | Y | N |

Y means the presence of a nacreous pigment.

N means no nacreous pigment

After the image was exposed and developed, the samples were viewed by visual examination under typical room light condition of a cool white fluorescent light.

The visual examination results are tabulated in Table 5. When viewing the sample, the print is rotated through an incident angle range from 0 to 70 degrees from the viewer. The viewer is looking for a rich lustrous appearance.

TABLE 5

| Example | Nacreous Appearance Observed |
|---|---|
| 1 | Yes |
| 2 | Yes |
| 3 | Yes |
| 4 | Yes |
| 5 | Yes |
| 6 | Yes |
| 7 | No |
| 8 | Yes |
| 9 | Yes |
| 10 | Yes |
| 11 | Yes |
| Control | No |

As the data from Table 5 indicate, whenever the nacreous pigment is present in a layer emulsion and even in the sub layer of the emulsion, there is an observed nacreous appearance. The observation was a visual assessment of the sample by reflected light. The control sample that did not have a nacreous pigment did not have a nacreous appearance.

What is claimed is:

1. A photographic element comprising nacreous pigment wherein said nacreous pigment in a gelatin layer free of silver halide emulsion and below at least one negative working silver halide emulsion layer containing dye forming coupler, wherein said at least one negative working silver halide layer comprises an emulsion forming latent image predominantly on the surface of the silver halide grains of said emulsion.

2. The photographic element of claim 1 wherein said element has an electrical resistance of less than $10^{13}$ log ohms per square.

3. The photographic element of claim 1 wherein said nacreous pigment is in an interlayer between silver halide emulsion layers containing color couplers.

4. The photographic element of claim 1 wherein said element further comprises ultraviolet protection.

5. The photographic element of claim 1 wherein said nacreous pigment is in a layer below the bottommost layer comprising silver halide.

6. The photographic element of claim 1 wherein said nacreous pigment comprises mica.

7. The photographic element of claim 1 wherein said nacreous pigment has a mean particle size between 0.5 and 50 micrometers.

8. The photographic element of claim 1 wherein said nacreous pigment is present in an amount between 0.5 and 1000 $mg/m^2$.

9. The photographic element of claim 1 wherein said nacreous pigment is present in an amount between 7 and 400 $mg/m^2$.

10. The photographic element of claim 1 wherein said nacreous pigment is present in more than one interlayer between emulsion layers containing dye forming coupler.

11. The photographic element of claim 1 wherein said nacreous pigment is present in a layer below the bottom layer containing silver halide emulsion.

12. The photographic element of claim 1 wherein said nacreous pigment comprises at least one member selected from the group consisting of mica, modified mica, feldspar, and quartz.

13. The photographic element of claim 1 further comprising a white reflective base.

14. The photographic element of claim 13 wherein said white reflective base has an L* of greater than 92.

15. The photographic element of claim 1 wherein said element has a FLOP of between 2 and 65.

16. The photographic element of claim 13 wherein said base has a roughness of less than 0.8 $\mu$m.

17. The photographic element of claim 12 wherein said mica is modified and further comprises a metal oxide.

18. The photographic element of claim 17 wherein said metal oxide comprises at least one member selected from the group consisting of titanium, aluminum, barium, iron, zinc, zirconium, bismuth vanadate, nickel titanate, and chromium titanate.

19. The photographic element of claim 17 wherein said metal oxide comprises titanium, aluminum, or barium.

20. The photographic element of claim 1 wherein said nacreous pigment comprises silicate coated with a material that has a difference in refractive index of 0.2 or greater.

21. The photographic element of claim 1 wherein said photographic element has an b* less than 10.

22. The photographic element of claim 1 wherein said element comprises three photosensitive layers;

one layer sensitive to blue light, one layer sensitive to green light, and one layer sensitive to red light.

23. A photographic element comprising nacreous pigment, wherein said element comprises at least two exposed and developed images that are folded with the image sides out and the non-image bearing sides are adhesively joined to form an album page.

24. The photographic element of claim 23 wherein said album page is formed using an apparatus for making an album leaf from an image bearing sheet having image bearing side and a non-image bearing side, comprising:

a first roller about which said image bearing sheet is driven;

a second roller positioned adjacent said first roller so as to form a first nip there between, said second roller is used for driving an adhesive sheet into said first nip against said image bearing sheet that is driven by said first roller; and a third roller positioned adjacent said first roller so as to form a second nip there between, said third and said first roller moving in a direction which caused said image bearing sheet to be folded firmly about said adhesive sheet and move through said second nip so as to form an album leaf.

* * * * *